US006153983A

United States Patent [19]

Nerone et al.

[11] Patent Number: 6,153,983

[45] Date of Patent: Nov. 28, 2000

[54] FULL WAVE ELECTRONIC STARTER

[75] Inventors: Louis R. Nerone, Brecksville; Laszlo S. Ilyes, Richmond Hts.; Mircea Voskerician, Cleveland, all of Ohio

[73] Assignee: General Electric Company, Schenectady, N.Y.

[21] Appl. No.: 09/358,110

[22] Filed: Jul. 21, 1999

[51] Int. Cl.[7] ..... H05B 37/00

[52] U.S. Cl. ..... 315/289; 315/224; 315/291; 315/DIG. 7

[58] Field of Search ..... 315/206 R, 209 T, 315/209 CD, 224, 225, 289, 290, 291, 307, DIG. 2, DIG. 5, DIG. 7, 59, 61, 63, 72

[56] References Cited

U.S. PATENT DOCUMENTS

| | | | |
|---|---|---|---|
| 3,504,658 | 4/1970 | Chavis | 315/290 |
| 3,622,837 | 11/1971 | Gellman | 315/209 T |
| 4,337,417 | 6/1982 | Johnson | 315/290 |
| 4,381,476 | 4/1983 | Adachi et al. | 315/101 |
| 4,419,607 | 12/1983 | Barakitis et al. | 315/73 |
| 4,489,255 | 12/1984 | Barakitis et al. | 315/73 |
| 4,603,378 | 7/1986 | Virta | 315/209 R |
| 4,647,817 | 3/1987 | Fahnrich et al. | 315/DIG. 7 |
| 5,004,960 | 4/1991 | Cockram et al. | 315/209 R |
| 5,010,274 | 4/1991 | Phillips et al. | 315/101 |
| 5,019,751 | 5/1991 | Flory, IV et al. | 315/290 |
| 5,057,752 | 10/1991 | Grabner et al. | 315/289 |
| 5,059,870 | 10/1991 | Choon | 315/289 |
| 5,097,177 | 3/1992 | Chiang | 313/619 |
| 5,319,286 | 6/1994 | Leyten | 315/289 |
| 5,406,177 | 4/1995 | Nerone | 315/307 |
| 5,532,555 | 7/1996 | Yamada | 315/241 P |
| 5,537,010 | 7/1996 | Johnson et al. | 315/289 |
| 5,540,205 | 7/1996 | Davis et al. | 123/486 |
| 5,543,690 | 8/1996 | Bernicke et al. | 315/224 |
| 5,594,308 | 1/1997 | Nuckolls et al. | 315/290 |
| 5,734,231 | 3/1998 | Lee et al. | 315/106 |
| 5,962,985 | 10/1999 | Buij et al. | 315/224 |

*Primary Examiner*—Don Wong
*Assistant Examiner*—Thuy Vinh Tran
*Attorney, Agent, or Firm*—Fay, Sharpe, Fagan, Minnich & McKee, LLP

[57] ABSTRACT

A fill wave electronic starter 10 includes an input circuit 12 which delivers a rectified voltage to charging capacitor 28. During a first state, voltage on charging capacitor 28 is used to turn on switching circuit 30, whereby current is delivered to cathodes 56 and 58. When voltage on capacitor 28 reaches a breakdown voltage of diode 46, latch circuit 50 is placed in an on state causing capacitor 28 to discharge, turning off transistor 32. This action delivers a high-voltage lamp ignition pulse 62 to lamp 60 causing it to start. Current flowing through input circuit 12 maintains conduction of latch circuit 50, rendering a low impedance state which maintains MOSFET transistor 32 off, and starter 10 in a disabled state after initial pulse 62.

19 Claims, 2 Drawing Sheets

FULL WAVE ELECTRONIC STARTER

FIELD OF INVENTION

The present invention relates to an electronic starter used to start fluorescent lamps. More particularly, the invention relates to a full wave electronic starter implemented as a solid state circuit which is limited to issuing a single lamp ignition signal during each attempted start-up procedure.

BACKGROUND OF THE INVENTION

A conventional manner of igniting fluorescent lamps is with the use of a glow bottle starter, especially in connection with compact fluorescent lighting applications. The glow starter is turned on at a voltage much lower than the fluorescent lamp it is to start. Initially, the glow starter is in a high impedance state, as the discharge gas within it heats up. This glow discharge heat acts to heat the bimetallic strip, causing contacts to close, thereby drawing current from the external ballasting inductor. The glow discharge ceases, thereby permitting the bimetallic strip to cool, until the contacts open. When the contacts open, energy stored in the ballast inductor generates a high voltage ignition pulse across the fluorescent lamp, causing lamp ignition. Once ignition occurs, the arc current builds up and the ballast inductor limits the current to the rating of the lamp. If the ignition pulse does not start the lamp, additional ignition pulses will be generated.

A drawback with glow starters is that, repeated ignition pulses accelerate deterioration of the lamp. Further, as lamps age there are times when the fluorescent lamp may be running, the glow starter could also turn on, ruining the discharge process in the fluorescent lamp itself Consequently, extensive heating could occur causing melting or less than desirable end-of-life failures of the product.

Others have attempted to provide non-glow electronic starters. One such system is discussed in U.S. Pat. No. 5,059,870 to Choon. This patent employs a triac having a trigger electrode, and having an anode and cathode. Further implemented is a positive thermistor and a time constant circuit such as an RC circuit to form a triggering network which is coupled to a triggering electrode. When the positive thermistor is heated by current flow in the circuit so that its resistance becomes greater, the trigger angle of the triac, which is controlled by the signal produced by the time constant circuit is varied. The trigger signal causes the triac to suddenly cut off at a selected voltage below the self-maintenance current of the triac producing a reactive voltage across the fluorescent lamp. The time at which the signal occurs changes as the thermistor heats, causing the reactive voltage to increase at each cycle of the a.c. power until the reactive voltage is sufficient to turn the lamp on. A drawback to such a circuit is the use of heating within the starter circuit itself, which can decrease the life expectancy of the starter circuit. A further disadvantage is the cost of the elements to create the cited electronic circuit. Also, starters such as Choon cannot be started substantially instantaneously after it is turned off after operation. Rather, a shutdown or cooling off period will need to be provided for the heating element.

It would be desirable to provide an electronic starter, for a fluorescent lamp, which provides only a single ignition signal for each power-up of the system, in order to eliminate undesirable repeated starting attempts, as well as to eliminate inappropriate start attempts during operation of the lamp itself. It is also desirable to provide an electronic starter having an extended life span which has substantially instantaneous starting and which uses components that provide for economic benefits in the manufacturing process.

SUMMARY OF THE INVENTION

An exemplary embodiment of the invention provides a full wave electronic starter for a fluorescent lamp system. The electronic starter includes an input circuit which receives a ballast voltage, wherein the input circuit rectifies the voltage to a d.c. signal. A charging capacitor connected to the input circuit, is configured to store the rectified d.c. voltage. The input circuit and the charging capacitor have connected thereto a switch, which may be formed as an n-channel MOSFET switch with a full bridge diode supply circuit. A pair of lamp cathodes are connected to the switch to provide current to the lamp cathodes when the switch is in an on position. A latch circuit is connected between the input circuit and the lamp cathodes, and a Zener diode circuit is connected between the latch input and the lamp cathodes. Connection of the Zener diode circuit between the latch input and lamp cathodes act to maintain the latch in an off state for up to a predetermined rectified voltage stored on the charging capacitor. Once the rectified voltage on the charging capacitor is greater than the rated voltage of the Zener diode circuit, the latch circuit is moved to an on state, turning the switch off and causing the charging capacitor to discharge through the lamp electrodes. The sudden interruption of the reactive cathode current provides a lamp ignition signal to the fluorescent lamp. Once the charging capacitor has discharged, a holding current is supplied to the latch to maintain the latch in an on state, inhibiting the generation of any further lamp ignition signals.

DETAILED DESCRIPTION OF THE INVENTION

Figure 1:
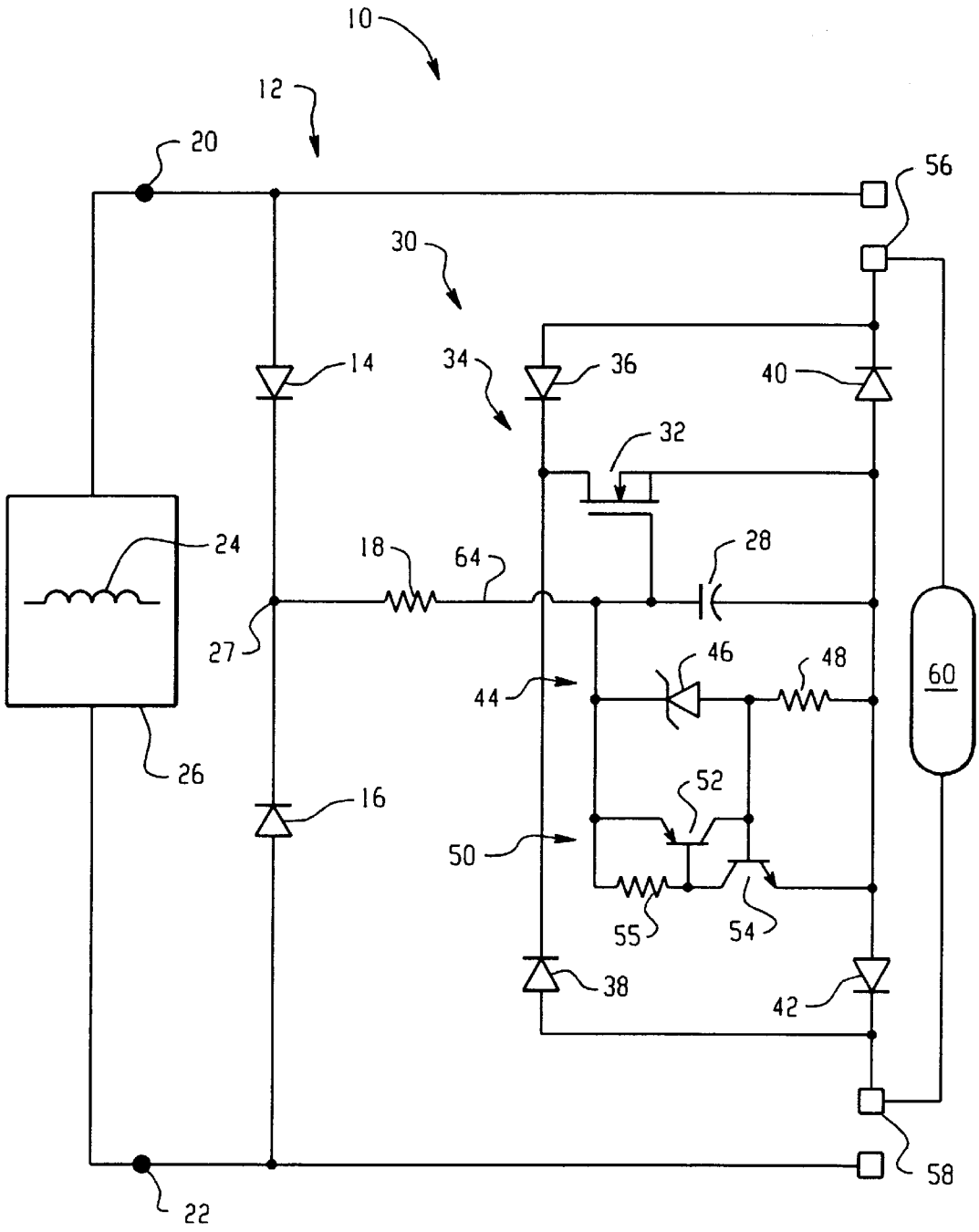
FIG. 1 is a schematic diagram of a full wave electronic starter according to the teachings of an embodiment of the present invention.

FIG. 1 shows a full wave electronic starter 10, in accordance with an embodiment of the present invention. An input circuit 12 including rectifying diodes 14 and 16 as well as resistor 18 are connected through terminals 20 and 22 to an inductor 24 of ballast 26, shown in a simplified version for this discussion. It is to be appreciated that the concepts of the present invention are specifically directed to inductively fed ballasts, and also, while the diodes and resistors are shown as single elements they may be implemented as multiple elements having the same functions. Input circuit 12 receives an open circuit voltage, rectifies this voltage, applies it to node 27, and delivers a rectified d.c. voltage to charging capacitor 28. A switching network 30 consists of a switch 32 and diode bridge network 34. Switch 32, may be an n-channel MOSFET supplied, when in operation, by diode bridge network 34 consisting of diodes 36–42. A voltage control network 44 consists of Zener diode 46 and resistor 48 connected across latch circuit 50. In one embodiment latch circuit 50 is comprised of an appropriately connected pnp transistor 52, npn transistor 54 and resistor 55. Lamp cathodes 56 and 58 of lamp 60 are connected to full wave electronic starter circuit 10.

In operation, voltage of ballast inductor 24 is used to charge charging capacitor 28 through resistor 18 and diodes 14 and 16. Diodes 14 and 16 rectify the voltage from inductor 24 to a d.c. level. At the time the threshold voltage of switch 32 is reached, switch 32 begins operation. An energy build-up will occur through the inductor's ballast caused by a high current.

When the charging voltage of charging capacitor 28 exceeds the Zener breakdown voltage of Zener 46, latch 50 sees the Zener breakdown voltage across it, and activates latch 50. At this point, capacitor 28 begins discharging, and the voltage across switch 32 drops below the transistor threshold limit turning off switch 32. Turning off of switch 32 results in the generation of a high voltage lamp ignition pulse, which is delivered across the lamp cathodes 56 and 58, causing lamp 60 to start.

A holding current 64 of FIG. 1, will flow through rectifying diodes 14, 16 and resistor 18, maintaining latch 50 in an on state, once switch 32 has been turned off.

Therefore, after an initial ignition pulse is issued, full wave electronic starter 10 becomes inactive whether or not the ignition pulse was sufficient to turn lamp 60 to an on state. Thus, repeated generation of ignition pulses are suppressed. Multiple firing of ignition pulses is avoided by ensuring holding current 64 through resistor 18 is of a sufficient value to maintain latch 50 in an on state, i.e. The latch is closed. In order to generate another ignition pulse 62, it is necessary to disable latch 50 by removing power to starter 10 and then re-apply power. The disabling of latch 50 is discussed in greater detail below. It is also noted electronic starter 10 may be started substantially instantaneously upon re-powering of electronic starter 10.

Only when latch 50 does not have sufficient holding current to be maintained active will an alternating on/off switching mode situation occur with respect to switch 32. This sufficient holding current 64 is provided by proper selection of the circuit components, thereby assuring a flicker-free operation.

A typical open circuit voltage value will range from 220 volts to 400 volts when trying to start full wave electronic circuit 10 from, for example, a transformer ballast 26. When this open circuit voltage is applied to terminals 20 and 22, it will be insufficient to start the fluorescent lamp 60 by itself However, it is known that the voltage required to start a fluorescent lamp 60 decreases as preheating is applied to cathodes, because of the availability of free electrons from the cathode heating. When the open circuit voltage has been rectified and delivered to charging capacitor 28, and charging capacitor 28 has charged past the point of threshold voltage of switch 32, switch 32 turns on and begins conducting a full wave current through cathodes 56 and 58. The current in cathodes 56 and 58 alternate due to the full wave configuration switching network 30.

As previously noted, when the voltage on charging capacitor 28 exceeds the breakdown voltage of Zener diode 46, current will be allowed to flow into latch 50, comprised of pnp transistor 52 and npn transistor 54.

Latch 50 is known as a one-shot device. In particular, this latch is configured of a special manner of connection between a pair of transistors. The collector of transistor 52 drives the base of transistor 54, and the collector of transistor 54 drives the base of transistor 52. By this arrangement, there is a direct coupled feedback. Additionally, the feedback is positive since a change in current at any point in the loop is amplified and returned to the starting point with the same phase. Latch 50 will ideally exist in either of an open or a closed state. If it is in an open position, it stays open until an input current forces it to close. If it is in a closed position, it stays in the closed state until an input current forces it to open. One manner to close latch 50 is by providing a triggering pulse. In one embodiment of this invention, the triggering pulse exists as the 12-volt breakdown voltage of Zener diode 46. When this triggering pulse is delivered to the base of transistor 54, the trigger momentarily forward biases the base of transistor 54. The returning amplified current will be significantly larger than the original input current. Since the collector of transistor 52 will then supply the base current of transistor 54, the trigger voltage is no longer needed. This is called a regenerative feedback since once started, the action will sustain itself. The regenerative feedback quickly drives both transistors 52, 54 into saturation, at which point loop gain drops to unity. The transistors will now remain saturated indefinitely.

One way to open latch 50 is by applying a negative trigger to the base of transistor 54 which pulls transistor 54 out of saturation. Once this occurs, regeneration takes over and quickly drives the transistors to cutoff points. Another manner in which to open latch 50 is by a low current dropout. This means reducing the voltage supplied to substantially zero, at which point transistors 52 and 54 come out of saturation and regeneration drives them to cutoff.

Once latch 50 is turned on, the voltage at MOSFET switch 32 is pulled low, essentially bringing the input voltage on the gate to source connection of MOSFET switch 32 below the threshold voltage, thereby shutting off MOSFET switch 32. As previously noted, as long as fill wave electronic starter 10 is supplied with a holding current through resistor 18, latch 50 is maintained in an on state, inhibiting generation of successive ignition pulses 62.

Benefits of inhibiting the generation of additional ignition pulses includes extending the life of the lamp. In particular, repeated striking of cathodes 56 and 58 with ignition pulses causes cathodes 56 and 58 to deteriorate thereby lowering the life of lamp 60. Thus, a benefit of the present invention is that under proper operation reissuing of ignition pulse 62 will not occur until the power to electronic starter 10 has been substantially cut off and the circuit recycled. An important additional benefit is that the starter will not attempt to restrike a badly aging lamp. Attempting to restrike a lamp with extremely worn cathodes can lead to undesirable, high temperature failure conditions.

Figure 2:
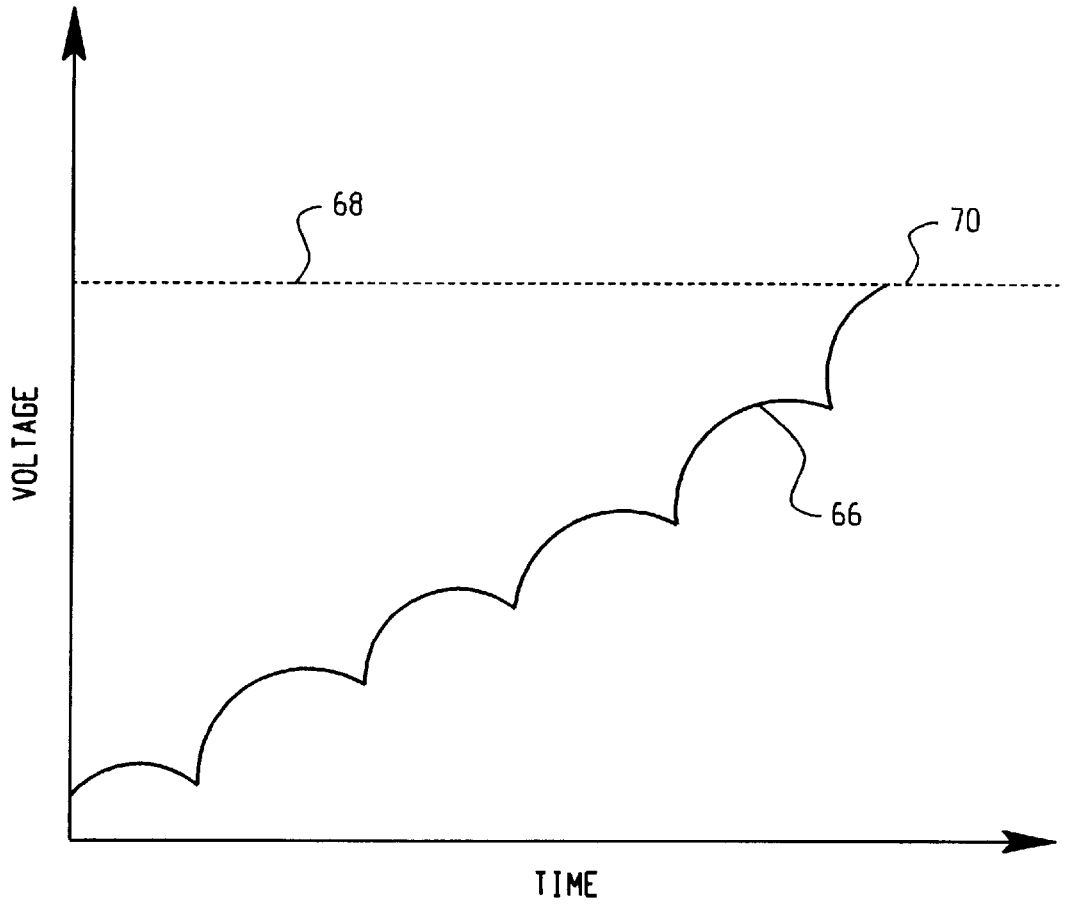
FIG. 2 illustrates the capacitor charging voltage in relationship to the Zener breakdown voltage of an embodiment in the present invention.

In the present embodiment, the voltage being stored on capacitor 28 is a full wave ripple pattern as shown for example in FIG. 2 as wave form 66. Since capacitor 28 charges in this ripple pattern, the likelihood the Zener breakdown voltage of Zener diode 46, will be exceeded at or near the peak of line current is greatly enhanced. For example, as shown in FIG. 2, Zener breakdown voltage 68 is intersected at a peak of a ripple 70 of full wave ripple pattern 66. Thus, latch 50 is activated, at or near the peak of current through the cathodes. It is at this time that ballast inductor 24 will store maximum energy. The consequence of this relationship is that when MOSFET switch 32 is turned off, a peak voltage, dictated by the avalanche voltage of MOSFET switch 32 is delivered across lamp cathodes 56 and 58 and across lamp 60. This arrangement enhances the ability to start lamp 60 even under varied conditions, and therefore provides a more robust and more reliable starting of lamp 60.

It is also known that resistance of lamp cathodes 56 and 58 change as they are heated. One of the ways that fluorescent lamp manufacturers determine the quality of a preheat operation, is by measuring the ratio of the resistance of the lamp cathodes when they are cold (i.e., room temperature) divided into the resistance of the lamp cathodes once they have been heated. This is commonly known as the $r_h/r_c$ ratio.

Using this information in one embodiment of the present invention, it is possible to determine when the most desirable preheat of cathodes 56, 58 has been reached by monitoring the resistance of the cathodes. Using full wave electronic starter 10, the charging current being delivered to capacitor 28, through the full bridge configuration diodes 36–42 of MOSFET switch 32, causes the charging current to be proportional to the lamp cathode resistances. As a consequence, the time it takes for full wave electronic starter 10 to reach the threshold level of Zener diode 46, will vary depending upon the preheat value. Therefore, the present circuit provides an inherent feedback as to the preheat temperature of the cathodes through the present design. This increases the robustness and reliability of the circuit over a wider range of operating variables and ballasts and lamp types.

Latch 50 was selected for use in the present embodiment as it requires only a small amount of holding current to remain it in an on state. Other devices could also be used in place of this trigger device. For example, a semi-conductor bilateral trigger device could be used, however, the holding current required to keep it on is significantly higher, and consequently, the design will not be as robust.

Additionally, as previously noted, to obtain an ignition pulse after an initial ignition pulse 62 has issued, it is necessary that the input voltage go below the threshold voltage of latch circuit 50. It is necessary to lower the voltage below the point where the lamp 60 would remain lit in order to restart electronic starter 10. Thus, even if the lamp begins to age, and begins to operate at progressively lower than rated voltage levels, by proper selection of resistor 18, electronic starter 10 will be inhibited from turning on while the lamp is lit, which would generate additional heating to the cathodes of the lamp. This insurance provides another additional robust feature of the present invention.

The above feature, which only preheats the cathodes once and strikes the lamp once, also results in a desirable effect of extending the life of the lamp. Particularly, it is known that repeated striking of a fluorescent lamp by repeated application of high voltage to the cathodes draws the emission mix from the heated cathodes. It is also known that a principle reason for end-of-life failures of a lamp is the depletion of this emission mix from the cathodes. Thus, by reducing the number of ignitions to the lamp, the lamp life is extended.

If a trigger device other than a latch were used, it would be necessary to provide additional current to maintain it in an on position, which increases the likelihood that it would come on at some time during the time that the lamp is lit.

An observation in connection with electronic starter 10, is that the switching/starting operation closely depends on the value of cathode resistance and the $R_{ds\text{-}on}$. of MOSFET switch 32. In one embodiment of the invention, the cathode resistance is 2.6 ohms and the $R_{ds\text{-}on}$ of MOSFET switch 32 is 5.9 ohms. It has been noted by the inventors that the time to perform a start operation will increase with higher $R_{ds\text{-}on}$, and $R_{ds\text{-}on}$ with a lower value will tend to decrease the start time, as the charging rate of charging capacitor 28 depends on the value of $R_{ds\text{-}on}$. A desirable nominal $r_h/r_c$ ratio for the present embodiment is 4.75 for the hot-to-cold cathode resistance ratio. To filter out noise which may come into the system, additional capacitance filtering elements may be added.

Experiments have been undertaken with a 120 volt/60 hertz ballast and a 277 volt/60 hertz ballast.

It has been shown experimentally that a 1.1 second start, flicker-free ignition of a 26 watt lamp is obtainable. The experiment was undertaken at room temperature, with 120 volt/60 hertz ballast used with a 12 volt Zener diode.

A 2.9 second start time was obtained for a 26 watt lamp during experimental trials at room temperature for a 277 volt/60 hertz ballast using a 6.2 volt Zener diode. The 120 volt/60 hertz ballast, with a 12 volt Zener diode had a starting pulse of 779 Vrms for 776 $\mu$s. When the 277 volt/60 hertz ballast was used, the starting pulse was not avalanching at 425.5 Vrns and was on for a period of 148 $\mu$s.

Exemplary component values for a circuit of FIG. 1 are as follows for a lamp 60 rated at 26 watts, with a 200–400 volt open circuit voltage received by terminals 20 and 22. The ballasts used for the following data are the 120 volt/60 hertz ballast (ballast A) or a 277 volt/60 hertz ballast (ballast B):

| | |
|---|---|
| Diodes 14,16 | 1 amp 1,000 volts maximum recurrent peak reverse voltage |
| Resistor 18 | single 100 k ohm resistor, or two 47 k ohm resistors |
| Capacitor 28 | .33 microfarad/16 volt/10% |
| MOSFET 32 | 1 amp/500 volt/$R_{ds\text{-}on}$ = 5.9 ohm |
| Zener diode 46 | 12 volts (Ballast A); 62 volts (Ballast B) |
| Resistor 48 | 10 k ohms |
| Latch 50 | a pnp/npn latching package such as a FMB 3946/Fairchild SSOT-6 or separate packages such as MMBT 3906 and 3904 or SOT-23 by Fairchild semiconductor |
| Diodes 36–42 | 1 amp/1,000 volt maximum recurrent peak reverse voltage |
| Resister 55 | 100 ohms |

The foregoing description has focused on use of the present invention in connection. With 120 volt/60 hertz and 277 volt/60 hertz ballasts. However, the concepts of the present invention may be extended to other environments, such as, but not limited to, ballasts designed for use with a 230 volt/50 hertz line voltage An electronic starter according to the concepts of the present invention designed for use with a line voltage of 230 volts/50 hertz has been designed and tested by the inventors.

What is claimed is:

1. A full wave electronic starter for a compact fluorescent lamp comprising:

an input circuit for receiving an open circuit voltage and rectifying the voltage;

a charging capacitor connected to the input circuit, configured to accumulate the rectified voltage;

a switch connected between the input circuit and the charging capacitor;

a pair of lamp cathodes connected to the switch such that the switch provides a preheat current to the lamp cathodes when the switch is on;

a latch connected between the input circuit and the lamp cathodes; and a Zener diode circuit connected between the latch and the lamp cathodes to maintain the latch in an off state for up to a predetermined rectified voltage stored on the charging capacitor, wherein once the rectified voltage on the charging capacitor is greater than the rated value of the Zener diode circuit the latch is moved to an on state, turning the switch off and causing the charging capacitor to discharge through the lamp electrodes.

2. The invention according to claim 1 wherein the input circuit generates a holding current provided to the latch after the charging capacitor discharges through the lamp electrodes.

3. The invention according to claim 2 wherein the discharge by the charging capacitor to the lamp electrodes is a lamp ignition signal.

4. The invention according to claim 3 wherein the lamp ignition signal is issued only once while the holding current is provided to the latch.

5. The invention according to claim 1 wherein the starter is a solid state circuit.

6. The invention according to claim 1 wherein the voltage accumulating in the circuit capacitor is a full-wave ripple pattern.

7. The invention according to claim 6 wherein the voltage of the Zener diode circuit is exceeded at or near a peak of the full-wave ripple pattern.

8. The invention according to claim 1 wherein the charging current is delivered to the charging capacitor through a full bridge diode rectifier.

9. The invention according to claim 1 wherein the charging voltage is proportional to resistances of the lamp cathodes.

10. The invention according to claim 9 wherein a desired preheat of the lamp cathodes is determined in accordance with a $r_c/r_h$ ratio, where $r_c$ is the resistance of the cathodes when cold, and $r_h$ is the resistance of the cathodes when they are heated to a certain temperature, and the $r_h$ is determined by a proportion of the charging voltage.

11. The invention according to claim 1 wherein the switch is a n-channel MOSFET.

12. The invention according to claim 1 wherein the latch includes a pnp-npn transistor pair.

13. A full wave electronic starter for a compact fluorescent lamp comprising:

an input circuit for receiving an open circuit voltage and rectifying the voltage;

a charging capacitor connected to the input circuit, configured to accumulate the rectified voltage;

a switch connected between the input circuit and the charging capacitor;

a pair of lamp cathodes connected to the switch such that the switch provides a current to the lamp cathodes when the switch is on;

a latch connected between the input circuit and the lamp cathodes; and, a Zener diode circuit connected between the latch and the lamp cathodes to maintain the latch in an off state for up to a predetermined rectified voltage stored on the charging capacitor, wherein once the rectified voltage on the charging capacitor is greater than the rated value of the Zener diode circuit the latch is moved to an on state, turning the switch off and causing the charging capacitor to discharge through the lamp electrodes, wherein the voltage of the Zener diode circuit is exceeded when the maximum energy is stored in a ballast inductor.

14. A full wave electronic starter comprising:

a pair of input terminals;

a pair of lamp cathodes;

a diode bridge connected to the lamp cathodes;

a first input diode connected at one end to one of the input terminals;

a second input diode connected at one end to another one of the input terminals, and at another end to the first input diode at a first node;

a resistor connected at one end to the first node;

a charging capacitor connected at one end to the resistor and at another end to the diode bridge;

a switch having a plurality of inputs, at a first input the switch connected between the resistor and the capacitor, and at second and third inputs connected to the diode bridge;

a latch connected between the resistor and the capacitor;

a Zener diode connected at one end to the latch; and a second resistor connected at one end to the Zener diode and at another end to the diode bridge.

15. The invention according to claim 14 wherein the switch is a n-channel MOSFET.

16. The invention according to claim 14 wherein the latch includes a pnp-npn transistor pair.

17. The invention of claim 14 wherein the charging capacitor is configured to hold a lamp ignition signal, generated when the charging capacitor is discharged.

18. The invention of claim 17 wherein the lamp ignition signal is issued only a single time once the latch is activated.

19. The invention of claim 18 wherein a charging voltage for the charging capacitor is proportional to resistances of the pair of lamp cathodes.

* * * * *